US005918942A

United States Patent [19]

Olsen

[11] Patent Number: 5,918,942

[45] Date of Patent: Jul. 6, 1999

[54] CHAIR ARRANGEMENT

[76] Inventor: Terje Steiner Olsen, N-6024, Eidsnes, Norway

[21] Appl. No.: 08/973,844

[22] PCT Filed: Jun. 14, 1996

[86] PCT No.: PCT/NO96/00146

§ 371 Date: Apr. 6, 1998

§ 102(e) Date: Apr. 6, 1998

[87] PCT Pub. No.: WO97/00035

PCT Pub. Date: Jan. 3, 1997

[30] Foreign Application Priority Data

Jun. 16, 1995 [NO] Norway ..... 952410

[51] Int. Cl.[6] ..... A47C 1/035

[52] U.S. Cl. ..... 297/423.32; 297/83; 297/321; 297/423.36; 297/423.28

[58] Field of Search ..... 297/68, 83, 84, 297/320, 321, 423.3, 423.31, 423.32, 423.33, 423.36, 423.28

[56] References Cited

U.S. PATENT DOCUMENTS

| | | | |
|---|---|---|---|
| 639,076 | 12/1899 | May | 297/423.36 X |
| 4,509,795 | 4/1985 | Brennan et al. | 297/423.36 X |
| 5,033,793 | 7/1991 | Quintile | 297/423.33 |
| 5,597,210 | 1/1997 | Pickard | 297/423.3 X |

FOREIGN PATENT DOCUMENTS

| | | | |
|---|---|---|---|
| 3531879 A1 | 3/1987 | Germany . | |
| 76661 | 4/1950 | Norway . | |
| 2158350 | 11/1985 | United Kingdom | 297/423.32 |

OTHER PUBLICATIONS

PCT International Search Report, Sep. 9, 1966.

*Primary Examiner*—Peter R. Brown

*Attorney, Agent, or Firm*—Jenkens & Gilchrist, P.C.

[57] ABSTRACT

Adjustable chair equipped with a calf supporting board which by means of an over-center mechanism and a gas spring can be brought to a horizontal position when the angle between the seat and the back of the seat increases, the board being foldable when the angle is decreased.

10 Claims, 2 Drawing Sheets

CHAIR ARRANGEMENT

The present invention relates to a chair comprising a leg support (calf support), wherein the angle between seat and back support is step-less adjustable, wherein the front edge of the seat is link connected with a calf supporting board, wherein the front edge of the seat is link connected with a telescopic support upwardly inclining from the base of the chair and comprising a first supporting member firmly attached to said base, and a second supporting member which is slidable in relation to said first supporting member and is link connected with the front edge of the seat, there being firmly attached to the front edge of the seat a fastening extending downwardly and rearwardly along the outside of said support, a gas spring being link connected at its one end with said fastening and at its other end being pivotably connected with the free end of an arm which extends from the bottom side of said board at the rear end thereof close to said link connection between the seat and the board.

A chair of this type is known from Norwegian Patent Application No. 93.2452.

For further information of the prior art, reference is made to Norwegian Patent Specification No. 76.661 and German Published Specification 3.531.879.

In addition there are a plurality of such known chair solutions, especially in connection with so called "deck chairs". However, there exists a great desire in a simple manner to remove the calf supporting board when the user of the chair wishes to take an erected position in the chair.

For this purpose the present invention devises a simple and practical solution, and the arrangement is primarily characterized by:

that a gliding hook bar is link connected with said arm at the free end thereof, said gliding hook bar having a protrusion having a first inclined surface and at an angle therewith having a second inclined surface merging into a hook portion, and wherein said first inclined surface merges into a lower, free end portion of said bar, that an angle iron is firmly attached to said first supporting member, said gliding hook bar being adapted to slide in contact with the horizontal portion of said angle iron and in a desired, preferably horizontal use position of said board without being in contact with said angle iron, that a U-shaped loop having horizontal U-branches is firmly attached to said fastening, said sliding hook bar being adapted to fit in between the U's branches which are at different levels, and that:

by increasing angle between the seat and back of the chair said sliding hook bar is effected to be displaced upwardly in relation to said angle iron, so that when said second inclined surface comes in contact with said angle iron and commences to climb thereon, this displacement will together with the slidable contact of the sliding hook bar against the uppermost positioned branch of said U-loop effect a turning moment on said sliding hook rod, so that the end thereof which together with an end of said gas spring is link connected with said arm, will obtain a displacement downwardly and forward, whereby the end of the gas spring which is link connected with said arm will centre-over to a position in which expansion of said gas spring is possible and effect the board to take a desired, preferably horizontal position, at the same time as said hook portion will engage the lowermost positioned branch of said U-loop and prevent a downward displacement of said board, and said free end portion of said rod moving some distance away from said angle iron and at decreasing angle between the seat and the back of the chair the free end portion of said sliding hook rod is effected to come in contact with and slide along said angle iron, since when said first inclined surface comes in contact with said angle iron and climbs thereupon, said hook will come out of engagement with said U-loop, whereby said sliding hook rod slides along said angle iron at the same time as said board is moved downwardly by the weight of the users' leg and said second supporting member moves downwardly along and in cooperation with said first supporting member until the free end of said arm is in a centre-over position preventing operation of said gas spring.

According to a further embodiment of this arrangement, said calf supporting board can be equipped with telescoping means, whereby the length of said board is adjustable, and that said board at its forward, free end is equipped with a wheel or a wheel pair which can rest against the floor or foundation on which the base of the chair rests, possibly against the base of the chair when said board takes a downwardly inclined or rearwardly inclined position, said telescoping means due to the contact of the wheels against said floor, or similar, at the same time effecting that the length of said board is reduced.

The invention will now be explained in further details reference being had to the attached drawings.

Figure 1:
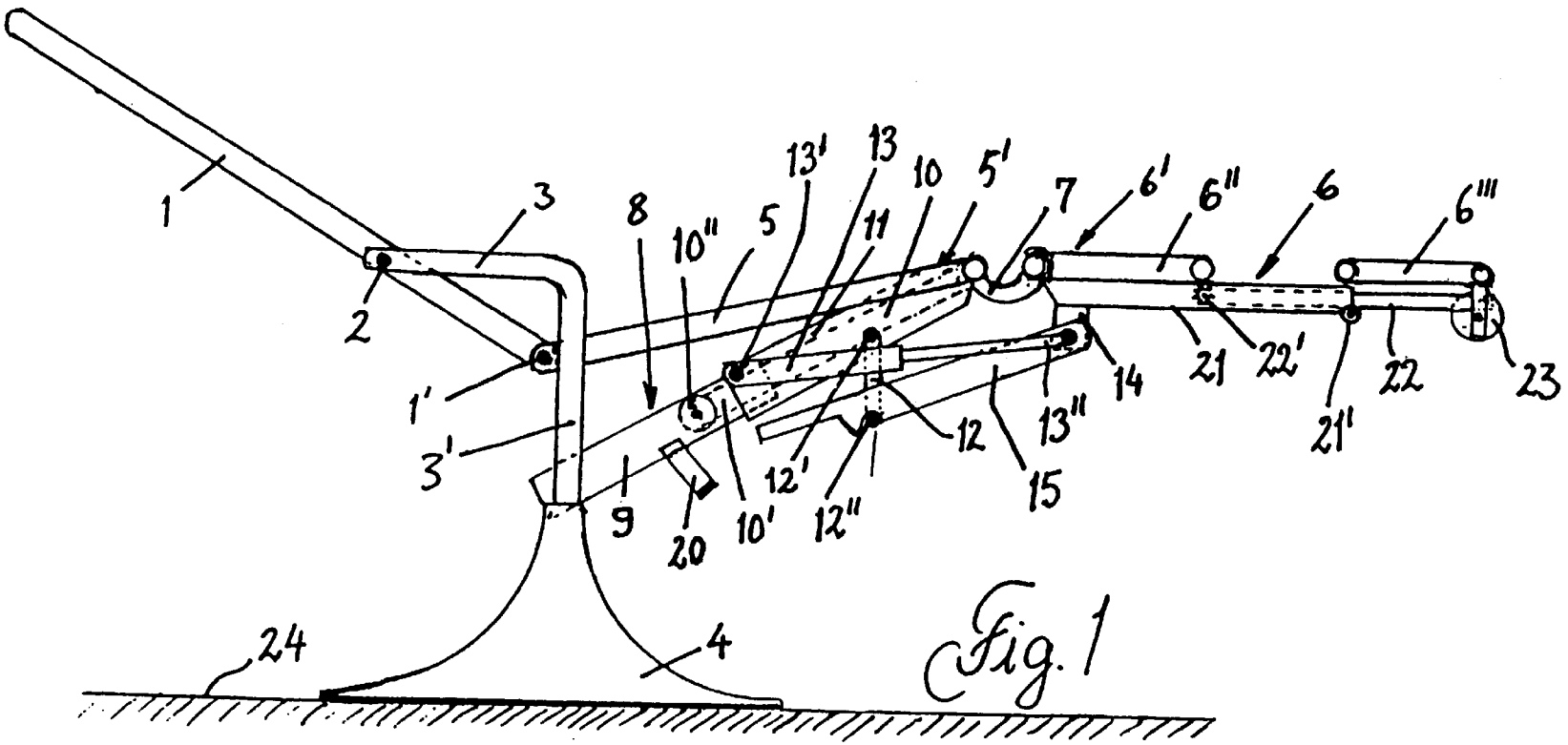
FIG. 1 illustrates the arrangement, according to the invention, in a first use position of the chair.
Figure 2:
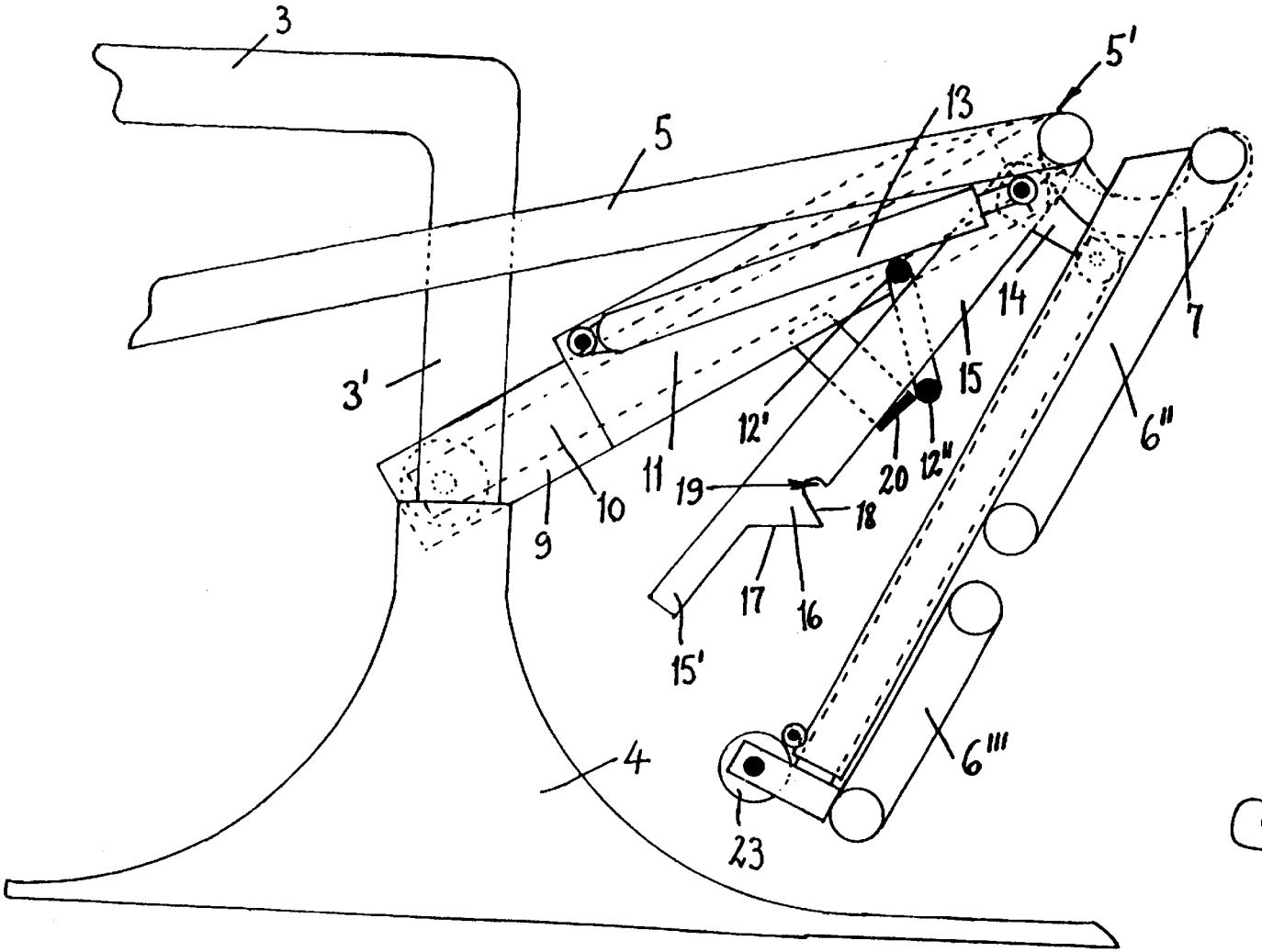
FIG. 2 illustrates the arrangement, according to the invention, in connection with a second embodiment of the chair.

The chair is provided with a back support 1 which is link connected with a pivoting point 2 of an arm rest 3 which merges into a vertical portion 3' and is terminated at the base 4 of the chair. The chair back 1 is connected to the seat 5 of the chair through a link connection 1'. The calf supporting board of the chair is designated by reference numeral 6 and is connected to a front portion 5' of the chair seat through a hinge connection 7. At the front edge 5' of the seat there is link connected a telescopic support 8 which extends upwardly inclining from the base 4 of the chair and comprises a first supporting member 9 firmly attached to the base 4, and a second supporting member 10 which is slidable in relation to said first supporting member 9 as illustrated with a broken line, and which is link connected with the front edge 5' of the seat. This forwardly, upwardly inclining telescopic support 8 can for example be shaped as a cylinder and a piston rod, the piston rod 10' thereof, however, not being terminated in a piston, but to the contrary in a runner 10". At the front edge of the seat at the bottom side thereof there is firmly attached a fastening 11 extending downwardly and rearwardly along the outside of said support 8, at least across a certain length thereof. A U-shaped loop 12 wherein the U's branches 12', 12" are horizontal, is firmly attached to said fastening 11 at a position approximately in the middle between the ends of said fastening 11. A gas spring 13 is link connected at its one end 13' with the lower end portion of said fastening 11 and is at its other end 13" pivotally connected to a free end of an arm 14 extending out from the bottom side of the board 6 at the rear end 6' thereof close to the link connection 7 between said seat 5 and said board 6. As appearing from FIG. 1 said arm 14 extends downwardly when said board 6 takes an approximately horizontal position. Furthermore, a sliding hook rod 15 is link connected with said arm 14 at the free end thereof. As further illustrated in FIG. 2 the sliding hook rod 15 comprises a protrusion having a first inclined surface 17 and at an angle in relation thereto a second inclined surface 18 merging into a hook portion 19. It will further be seen that said first inclined surface 17 merges into a lower, free end portion 15' of said rod 15. An angle iron 20 is firmly attached to said first supporting member 9. The sliding hook rod 15 is adapted to slide in contact with the horizontal portion of said angle iron 20. In a desired, preferably horizontal use position of the calf supporting board 6, the end portion 15' of said sliding hook rod is not in contact with said angle iron 20, as this is clearly seen from FIG. 1. When the angle between the seat and the back 1 of the chair increases, the sliding hook rod 15 will be effected to move upwardly in relation to said angle iron 20. At the same time also the two members 9 and 10 of the telescopic support 8 will move in relation to each other, in addition to the fact that said fastening 11 will move upwardly since the latter is attached to the front portion of the bottom side of the chair seat 5. When said second inclined surface 18 is brought in contact with said angle iron 20 and starts its climbing on the horizontal portion thereof, this movement will together with the sliding abutment of said sliding hook rod 15 against the upper branch 12' of said U-loop 12 be to the fact that a turning moment is effected in clock-wise direction, seen in relation to FIG. 2. The end of the sliding hook rod 15 which together with the end 13" of the gas spring 13 is link connected with said arm 14, will thereby obtain a displacement downwardly and forwardly, whereby the end 13" of the gas spring which is link connected with the arm 14 will centre-over to a position wherein the expansion of the gas spring 13 now will be made possible, whereby the board 6 is effected to turn around the hinge connection 7 in a counter-clock direction until the board takes a desired, preferably horizontal position. As soon as the hook portion 16 has passed the angle iron 20 and likewise the end portion of said rod 15' has passed the angle iron 20, then the rod 15 will rest on the lowermost branch 12" of said U-hook 12 and the hook 19 will at last come into engagement with said lowermost branch 12". In this manner the calf supporting board 6 will consequently not be enabled to be folded when the chair is in rearwardly inclined position, as this is illustrated in FIG. 1.

However, when the angle between the back 1 and the seat 5 of the chair is decreased, i.e. when a person wishes to raise to a more upright position in the chair, then the free end portion 15' of the sliding hook rod is effected to abut against and slide along the angle iron 20. When said first inclined surface 17 on the protrusion 16 in time will reach the angle iron and come into contact with the latter, as well as start its climbing on said angle iron 20, then the hook 19 will come out of engagement with the U-loop, whereby the sliding hook rod will slide along the angle iron 20, at the same time as the calf supporting board 6 is moved downwardly by the weight of the users' leg (not illustrated). At the same time the second supporting member 10 will be moved downwardly along and in gliding cooperation with said first supporting member 9, until the free end of the arm 14 takes a centre-over position which prevents the operation of the gas spring 13. It will thus in the illustrated manner be achieved a technical simple, but functionally safe manner of equipping a chair which is stepless adjustable, with a calf supporting board 6, and wherein this board 6 is foldable when the chair is brought to an upright position.

The calf supporting board is equipped with telescoping means in the form of a pipe 21 and a rod 22 which can slide in said pipe 21 and at its end is equipped with a wheel 22' for providing an easy mutual movement between said parts 21 and 22. Further, the pipe 21 can at its open end be equipped with a roller 21' which secures an easy sliding movement of the part 22 also at the front edge of said pipe 21.

The calf supporting board 6 is divided in two members 6" and 6'" whereby the member 6" is stationary, whereas the member 6'" is moveable. The member 6'" is at its outer end equipped with a wheel 23, possibly a wheel pair coming to rest against the floor 24 or foundation on which the base of the chair is positioned, possibly against the base 4 of the chair when the board 6 takes a downwardly inclining or rearwardly inclining position (see FIG. 2), said telescoping means 21, 22 due to the contact of the wheel 23 with said floor or similar, at the same time causing causing the length of the board 6 to be reduced, since said two members 6" and 6'" thereby are brought closer together.

I claim:

1. A chair arrangement comprising:

a base for supporting said chair;

a back support pivotally attached to a seat wherein the angle between said back support and said seat is adjustable, and wherein said back support is pivotally connected to said base at a point spaced from the pivotal attachment between the back support and the seat;

a calf support attached by a hinge connection to a front edge of said seat;

a telescopic support extending from said base on an upward incline to said front edge of said seat and having a first supporting member fixedly attached to said base and a second supporting member slidably engaging said first supporting member and pivotally attached to said front edge of said seat;

a means interconnected between the telescopic support and the calf support for elevating said calf support as the angle between said back support and said seat is increased.

2. The chair arrangement recited in claim 1, wherein said means for elevating said calf support further comprises:

a fastening piece attached to an outer surface of said telescopic support;

an arm extending from an underside of said calf support;

a gas spring having a first end pivotally attached to said fastening piece and a second end pivotally attached to said arm;

a gliding hook bar pivotally attached to said arm-and said second end of said gas spring;

a protrusion on said gliding hook bar having a first inclined surface and a second inclined surface and a hook portion;

an angle iron rigidly attached to said first supporting member;

a U-shaped loop having a substantially horizontal first branch rigidly attached to said fastening piece and a substantially horizontal second branch positioned to allow said gliding hook bar to slide between said branches and wherein as an angle between said back support and said seat is increased said gliding hook bar slides upward until said second inclined surface engages said angle iron rotating said gliding hook bar clockwise and allowing said gas spring to extend thereby raising said calf support which is held in a horizontal position by said hook portion engaging said second branch of said U-shaped loop.

3. The chair arrangement recited in claim 2, wherein as said angle between said back support and said seat is decreased said gliding hook bar slides rearward until said first inclined surface engages said angle iron rotating said gliding hook bar counterclockwise to disengage from said second branch of said U-shaped loop and allowing said gas spring to be compressed thereby lowering said calf support.

4. The chair arrangement recited in claim 1, wherein said calf support is provided with a telescoping means for extending said calf support away from said seat.

5. The chair arrangement recited in claim 4, wherein said calf support is further provided with at least one wheel at a free end to contact said floor and assist in retracting said calf support as said chair is brought to an upright position.

6. The chair arrangement recited in claim 1, wherein the portion of said base pivotally connected to said back support forms an arm rest.

7. A chair arrangement comprising:

a back support pivotally attached to a seat wherein the angle between said back support and said seat is adjustable;

a base which rests upon a floor and supports said chair;

a vertical portion extending upward from said base and having a right angle bend to form an integral arm rest;

a calf support attached by a hinge connection to a front edge of said seat;

a telescopic support extending from said base on an upward incline to said front edge of said seat and having a first supporting member fixedly attached to said base and a second supporting member slidably engaging said first supporting member and pivotally attached to said front edge of said seat;

a fastening piece attached to an outer surface of said telescopic support;

an arm extending from an underside of said calf support;

a gas spring having a first end pivotally attached to said fastening piece and a second end pivotally attached to said arm;

a gliding hook bar pivotally attached to said arm and said second end of said gas spring;

a protrusion on said gliding hook bar having a first inclined surface and a second inclined surface and a hook portion;

an angle iron rigidly attached to said first supporting member;

a U-shaped loop having a substantially horizontal first branch rigidly attached to said fastening piece and a substantially horizontal second branch positioned to allow said gliding hook bar to slide between said branches and wherein as an angle between said back support and said seat is increased said gliding hook bar slides upward until said second inclined surface engages said angle iron rotating said gliding hook bar clockwise and allowing said gas spring to extend thereby raising said calf support which is held in a horizontal position by said hook portion engaging said second branch of said U-shaped loop.

8. The chair arrangement recited in claim 7, wherein as said angle between said back support and said seat is decreased said gliding hook bar slides rearward until said first inclined surface engages said angle iron rotating said gliding hook bar counterclockwise to disengage from said second branch of said U-shaped loop and allowing said gas spring to be compressed thereby lowering said calf support.

9. The chair arrangement recited in claim 7, wherein said calf support is provided with a telescoping means for extending said calf support away from said seat.

10. The chair arrangement recited in claim 9, wherein said calf support is further provided with at least one wheel at a free end to contact said floor and assist in retracting said calf support as said chair is brought to an upright position.

* * * * *